US007413465B2

(12) United States Patent
Taylor

(10) Patent No.: US 7,413,465 B2
(45) Date of Patent: Aug. 19, 2008

(54) INSULATION DISPLACEMENT SYSTEM

(75) Inventor: Robert N. Taylor, Coventry, RI (US)

(73) Assignee: Illinois Tool Works, Inc., Glenview, IL (US)

( * ) Notice: Subject to any disclaimer, the term of this patent is extended or adjusted under 35 U.S.C. 154(b) by 5 days.

(21) Appl. No.: 11/532,205

(22) Filed: Sep. 15, 2006

(65) Prior Publication Data

US 2007/0243752 A1 Oct. 18, 2007

Related U.S. Application Data

(63) Continuation-in-part of application No. 11/402,630, filed on Apr. 12, 2006.

(51) Int. Cl.
*H01R 4/24* (2006.01)

(52) U.S. Cl. ..... 439/409

(58) Field of Classification Search ..... 493/409, 493/579, 404–405, 497
See application file for complete search history.

(56) References Cited

U.S. PATENT DOCUMENTS

| | | | | |
|---|---|---|---|---|
| 4,537,456 | A * | 8/1985 | Brown et al. | 439/404 |
| 4,820,188 | A | 4/1989 | Collier et al. | |
| 4,891,020 | A | 1/1990 | Dunn | |
| 4,971,572 | A | 11/1990 | Hopper | |
| 5,399,098 | A | 3/1995 | Marshall et al. | |
| 5,622,516 | A | 4/1997 | Baggett et al. | |
| 5,632,081 | A | 5/1997 | Gerhard, Jr. | |
| 5,667,414 | A | 9/1997 | Karacora | |
| 5,964,620 | A * | 10/1999 | Takahashi et al. | 439/579 |
| 5,989,071 | A | 11/1999 | Larsen et al. | |
| 6,019,627 | A | 2/2000 | Embo et al. | |
| 6,074,237 | A | 6/2000 | Lee | |
| 6,120,319 | A | 9/2000 | Lee et al. | |
| 6,193,556 | B1 | 2/2001 | Escane | |
| 6,276,955 | B1 | 8/2001 | Hollensen et al. | |
| 6,280,230 | B1 | 8/2001 | Takase et al. | |
| 6,290,531 | B1 | 9/2001 | Onizuka et al. | |
| 6,296,514 | B1 | 10/2001 | Medina et al. | |
| 6,368,143 | B1 | 4/2002 | Adams | |
| 6,416,347 | B2 | 7/2002 | Kojima | |
| 6,468,103 | B1 | 10/2002 | Brower | |
| 6,729,899 | B2 | 5/2004 | Aekins et al. | |
| 6,761,576 | B1 | 7/2004 | Ye et al. | |
| 6,780,044 | B1 | 8/2004 | Sawyer et al. | |
| 6,835,089 | B2 | 12/2004 | Hayes et al. | |
| 6,953,362 | B2 | 10/2005 | Mossner et al. | |
| 2005/0233638 | A1 | 10/2005 | Taylor | |

* cited by examiner

*Primary Examiner*—Jean F Duverne
(74) *Attorney, Agent, or Firm*—Boyle Fredrickson S.C.

(57) ABSTRACT

An insulation-displacement assembly is disclosed. The insulation-displacement assembly includes a first insulation-displacement terminal (IDT) adapted to receive in a mating configuration a second IDT, the first IDT including a first plate that includes: a base edge and a slot configured to receive an electrical conductor surrounded by an insulator and to displace the insulator, wherein the slot extends towards the center of the first plate from a second edge located opposite the base edge. The insulation-displacement assembly further includes a first housing component coupled to the first IDT.

20 Claims, 14 Drawing Sheets

INSULATION DISPLACEMENT SYSTEM

CROSS-REFERENCE TO RELATED APPLICATIONS

This application is a continuation-in-part application of and claims priority to U.S. application Ser. No. 11/402,630, entitled "Insulation Displacement System", filed Apr. 12, 2006, the content of which is hereby incorporated by reference in its entirety.

TECHNICAL FIELD

This invention relates to insulation displacement systems, including insulation displacement systems used as a tap or splice.

BACKGROUND

Insulation displacement systems (IDS) provide a convenient way to establish an electrical connection between an electrical conductor and an electrical contact (e.g., an electric terminal, electric interface, a second electric wire, etc.).

A conventional IDS includes a terminal with an open slot extending from one edge of the terminal. A section of an electrical cable (which includes a single or multi-strand electrical conductor surrounded by an insulator) is directed into the slot in such a way that the longitudinal axis of the electrical cable and the longitudinal axis of the slot are substantially perpendicular. Typically, the width of the slot is narrower than the diameter of the conductor bundle. Thus, as the insulated cable is pressed into the slot, the edges of the slot cut into the insulation surrounding the electrical conductor(s) and displace the insulator, thereby exposing the electrical conductor (s). Additionally, as the exposed electrical conductor continues to travel into the slot, making contact with the electrically conducting edges of the slot, the substantially round shape of the conductor bundle is compressed into an oval shape, establishing an electric connection with the electrical contact.

SUMMARY

Disclosed herein is an insulation displacement assembly that includes a first insulation displacement terminal (IDT) adapted to receive in a mating configuration another IDT, and a housing component coupled to the IDT. In an embodiment, two such IDT's include slots that are each configured to receive a cable and displace the cable's insulation to expose the cable's conductor. In their mated configuration, the slots of the two IDT's are adjacent to each other but with opposite orientation to the wire bundle, and thus define a closed adjustable aperture that holds the conductors of the cable. This closed aperture maintains the wire bundle in a compressed state; the bundle cannot relax, for example, as a result of elastomenric deformation of the insulating jacket. The individual wires in the bundle cannot migrate up the throat (or open end) of the slot, as the slot is effectively capped by the adjacent terminals. In this fashion each terminal serves to support and cap the adjacent terminal. In addition, the slot of each terminal independently engages the wires of the bundle, thereby increasing the area of direct terminal-to-wire interface, which in turn facilitates current flow. Additionally, maintaining the wire bundle in a compressed state reduces the harmful effect of vibration. Also, when the wire bundle is designed to deliver power, maintaining the wire bundle in a compressed state enables a more even distribution of the power density amongst the wires of bundle.

In one aspect, an insulation-displacement assembly is disclosed. The insulation-displacement assembly includes a first insulation-displacement terminal (IDT) adapted to receive in a mating configuration a second IDT, the first IDT including a first plate that includes: a base edge and a slot configured to receive an electrical conductor surrounded by an insulator and to displace the insulator, wherein the slot extends towards the center of the first plate from a second edge located opposite the base edge. The insulation-displacement assembly further includes a first housing component coupled to the first IDT.

Embodiments may include one or more of the following.

The assembly may further include the second IDT, the second IDT including a second plate that includes a base edge, and a slot configured to receive the electrical conductor and displace the insulator, wherein the slot extends towards the center of the plate from a second edge located opposite the base edge. The assembly may further include a second housing component coupled to the second IDT. The surface of the plate of the first IDT may be placed substantially adjacent to the surface of the plate of the second IDT, and the second edge of the second IDT may be displaceable towards the base edge of the first IDT.

The second edge of each plate of each of the IDT's may be V-shaped, and each slot may extend from the respective V-shaped edge.

The slot of the first IDT and the slot of the second IDT may be substantially adjacent such that the slots define a closed adjustable aperture configured to hold the electrical conductor.

The first IDT may further include a folded blade extending from the first plate.

The first IDT further may include a rolled rail fastener configured to fixture and lock the second IDT.

The second housing component may be configured to be received in a complementary fit within the first housing component. The first housing component may include a hollow shell having an opening, and the second housing component may include a projection configured to be received within the opening of the hollow shell of the first housing component.

The first housing component and the second housing component may be constructed from an electrically insulating material.

The first IDT may be placed inside the hollow shell of the first housing, and the second IDT may be secured to the projection of the second housing.

The second housing component may include a shaft, and the first housing component may include a receiving hole configured to receive the shaft.

The first housing component and the second housing components may be configured to be placed on an assembly hand tool.

Each of the IDT's may further include at least one additional slot configured to receive a corresponding additional electrical conductor, such that when the IDT's are placed in their mated configuration the slots of the first IDT substantially overlap the respective slots of the second IDT.

In another aspect, an electrical tap connector assembly is disclosed. The electrical tap connector assembly includes a first insulation-displacement terminal (IDT) adapted to receive in a mating configuration a second IDT, at least one of the IDT's includes an electrically conducting member, wherein the mated first IDT and the second IDT are configured to electrically couple to a first electrical conductor surrounded by an insulator. The electrical tap connector assembly further includes a first housing coupled to the first IDT, and a second housing coupled to the second IDT, wherein the first housing and the second housing are configured to be placed in a complementary fit with each other. The electrical tap connector assembly also includes an electrically conducting receiver configured to be electrically coupled to a second electrical conductor, wherein the receiver is configured to receive the electrically conducting member.

In a further aspect, an insulation-displacement-system hand tool is disclosed. The insulation-displacement hand tool includes a first nesting jaw configured to receive a first housing component coupled to a first insulation-displacement terminal (IDT) that includes a first plate having a base edge and a slot configured to receive an electrical conductor surrounded by an insulator and to displace the insulator, and a second nesting jaw configured to receive a second housing component coupled to a second IDT that includes a second plate having a base edge and a slot configured to receive the electrical conductor surrounded by an insulator and to displace the insulator. The hand tool further includes a ratcheting hand tool having actuating jaws attached respectively to the first nesting jaw and the second nesting jaw, the actuating jaws configured to cause, in response to the application of force on the actuating jaws, the first nesting jaw and the second nesting jaw to move into a closed position such that the when the first housing and the second housing are placed respectively on the first nesting jaw and the second nesting jaw, the first IDT and the second IDT are placed in a mating configuration when the first nesting jaw and the second nesting jaw substantially reach the closed position.

In yet another aspect, a method for electrically coupling an electrical conductor surrounded by an insulator to an electrical contact is disclosed. The method includes placing on a first nesting jaw of an insulation-displacement-system hand tool a first housing component coupled to a first insulation-displacement terminal (IDT) that includes a first plate having a base edge and a slot configured to receive an electrical conductor surrounded by an insulator and to displace the insulator, and placing on a second nesting jaw of the insulation-displacement-system hand tool a second housing component coupled to a second IDT that includes a first plate having a base edge and a slot configured to receive the electrical conductor surrounded by the insulator and to displace the insulator. The method further includes placing the electrical conductor in the slot of first IDT, applying force to actuating jaws of a ratcheting hand tool, the actuating jaws are attached respectively to the first nesting jaw and the second nesting jaw, to cause the first nesting jaw and the second nesting jaw to move the first housing component and the second housing component into a closed position to thereby cause the front IDT and the second IDT to move into a mating position, and connecting mated IDT's to the electrical contact.

The details of one or more embodiments of the invention are set forth in the accompanying drawings and the description below. Other features, objects and advantages of the invention will be apparent from the description and drawings, and from the claims.

DESCRIPTION OF THE DRAWINGS

Like reference symbols in the various drawings indicate like elements.

DETAILED DESCRIPTION

Figure 1:
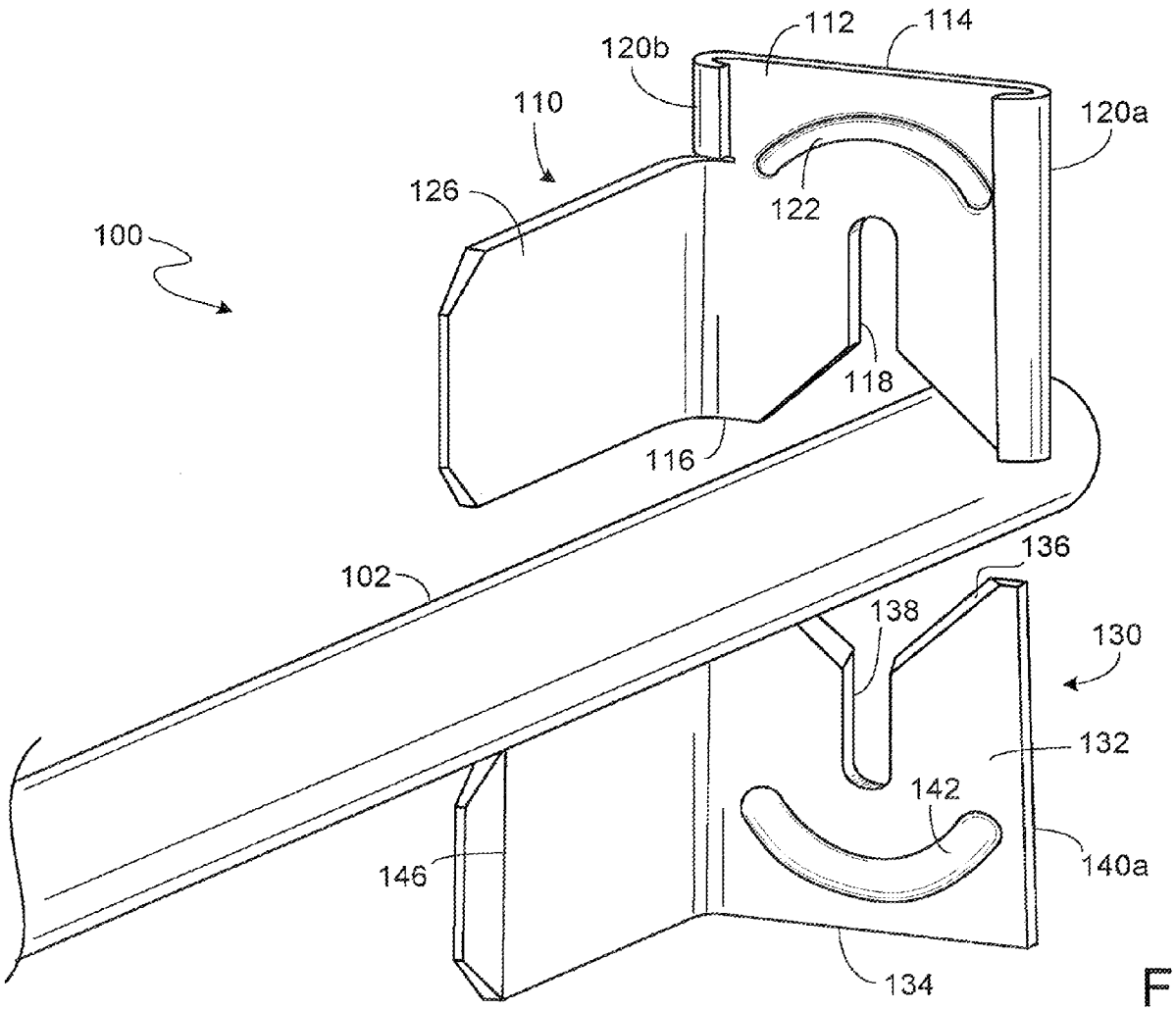
FIG. 1 is a perspective view of an exemplary embodiment of an insulation displacement system.

FIG. 1 is a perspective view of an exemplary embodiment of an insulation displacement system 100 used to establish an electric connection between an electric cable 102 that includes a single or multi strand electrical conductor surrounded by an insulator, and an electrical contact such as a crimp terminal (not shown). The electrical conductor may include one or more electrical wires configured to deliver electrical power or electrical/electronic signals.

The insulation displacement system 100 includes a first insulation displacement terminal (IDT) 110 that includes a plate 112. As shown in FIG. 1, the plate 112 has a substantially flat rectangular configuration, and is composed substantially entirely from an electrically conducting material (e.g., copper, aluminum).

The plate 112 has a base edge 114, and a second edge 116 that is located opposite the base edge 114. A slot 118 extends from the second edge 116 towards the center of the plate 112. In some embodiments, the second edge 116 of the plate 112 is V-shaped, thus enabling the cable to be easily guided along the contour of the second edge 116 towards the opening of the slot 118. In such embodiments, the slot 118 extends from the V-shaped edge. The second edge 116 may have other shapes and/or configurations.

The slot 118 is configured to receive the electrical cable 102. Particularly, the outside surface of a section of the insulator of the electric cable 102 is directed into the slot, for example by applying sufficient force on the cable to press it into the slot. The edges of the slot 118, which are electrically conducting, then slice and penetrate into the insulator of the cable 102. As a result, the edges of the slot 118 impede the movement of the cable along the slot. Consequently, as mechanical force continues to be applied on the cable 102, the edges of the slot 118 cause the insulator to be separated from the electrical conductor inside the insulator. The section of the insulation layer of the cable 102 received in the slot 118 is thus displaced, and the electrical conductor is exposed.

As further shown in FIG. 1, the first IDT 110 is adapted to receive in a mating configuration a second IDT, such as IDT 130. In some embodiments, the second IDT 130 includes a substantially rectangular flat plate 132 composed substantially entirely of an electrical conducting material. The second plate 132 of the second IDT 130 includes a base edge 134 and a second edge 136. A slot 138 extends from the second edge 136 towards the center of the second plate 132. The edges defining the slot 138 are electrically conducting. In some embodiments the second edge 136 of the second IDT 130 is V-shaped, and the slot 138 extends from the V-shaped edge towards the center of the second plate 132.

To receive the second IDT 130 in a mating configuration, the second edge 136 of the plate 132 of the second IDT 130 is aligned to receive another section of the cable 102. That other section of the cable 102 is located substantially opposite the side of the cable 102 having the section that was received by the slot 118 of the first IDT 110. Thus, for example, in FIG. 1 the first IDT 110 is positioned so that the slot 118 of the first IDT 110 is aligned to receive the top surface of a section of the cable 102. The second IDT 130, on the other hand, is positioned so that its slot 138 is aligned to receive the bottom surface of a substantially adjoining or overlapping section of the electric cable 102.

Figure 2:
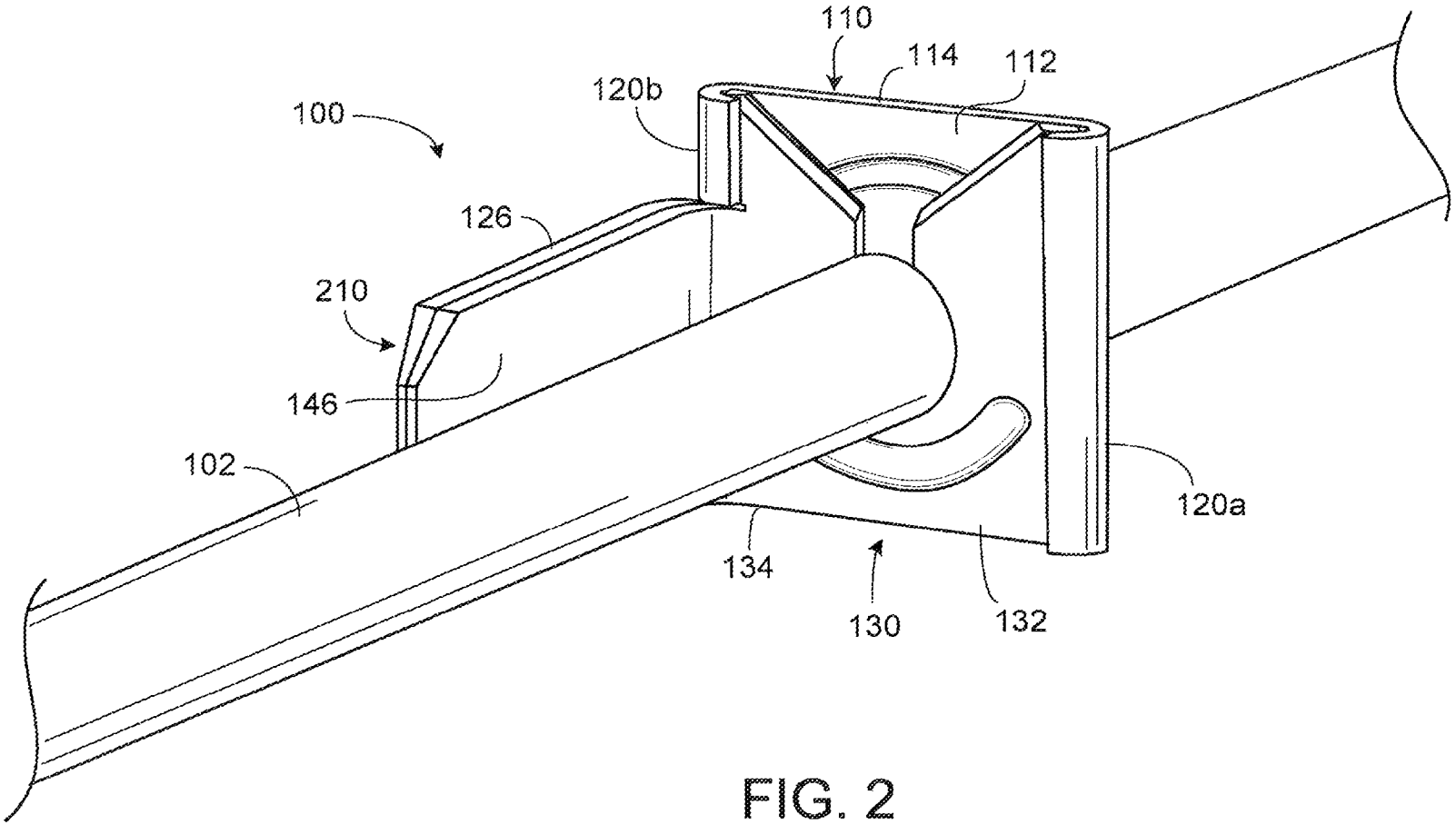
FIG. 2 is a perspective view of the insulation displacement system of FIG. 1 in which the insulation displacement terminals are in their mated position.

With reference to FIG. 2, to mate the first IDT 110 with the second IDT 130, the surface of the plate 112 of the first IDT 110 is placed substantially adjacent to the surface of the plate 132 of the second IDT 130. The displaceable second edge 136 of the second IDT 130 is displaced towards the base edge 114 of the first IDT 110. As the second edge 136 is displaced towards the base edge 114 of the first IDT 110, the edges of the slot 138 of the second IDT 130 slice the insulator at the bottom surface of the cable 102, and thus cause the sliced insulator to be displaced.

Figure 3:
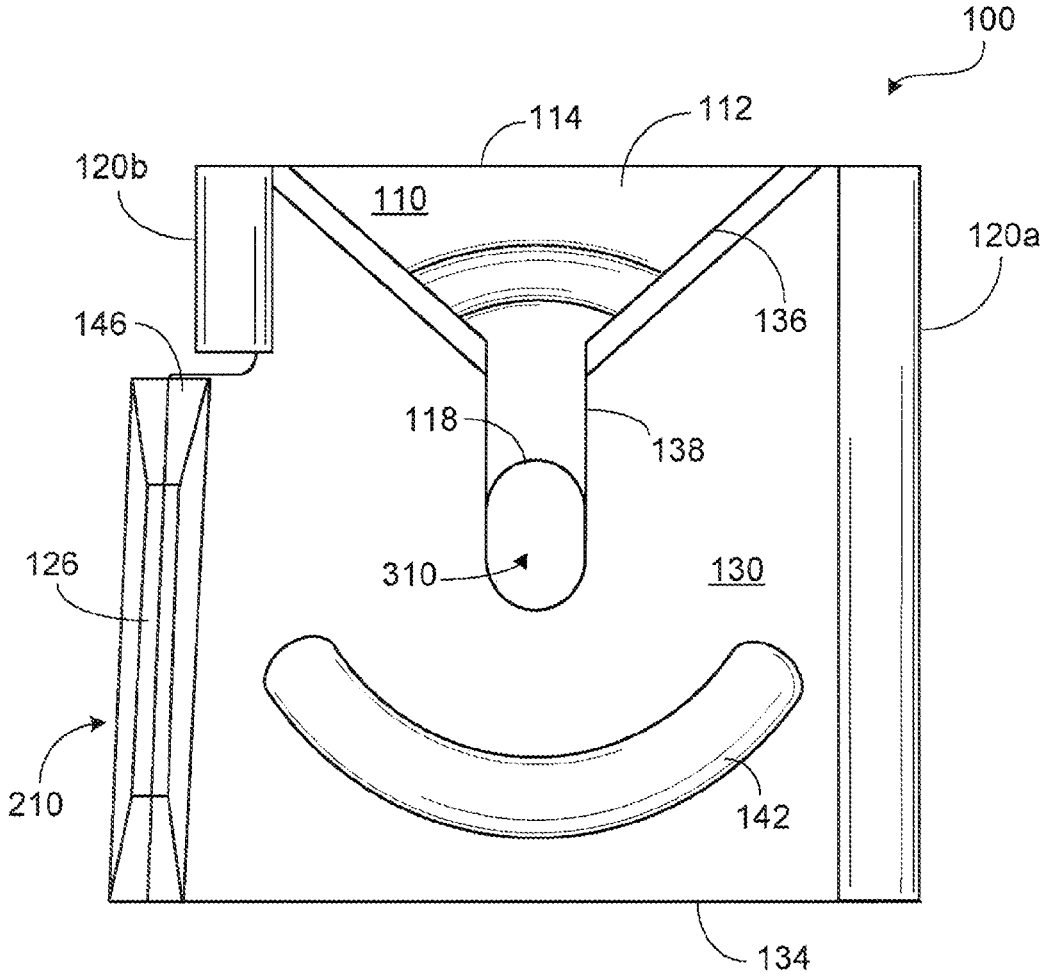
FIG. 3 is a front view of the insulation displacement system shown in FIG. 2.

With reference to FIG. 3, in their mated position the slot 118 of the first IDT 110 and the slot 138 of the second IDT 130 define a closed adjustable aperture 310 that holds the conductor(s) of the electric cable 102. The dimensions of the aperture are adjusted by controlling the extent of the displacement of one plate of one IDT relative to the plate of the other IDT. Thus, for example, the dimensions of the closed aperture 310, as shown in FIG. 3, may be increased by displacing the second edge 136 of the second IDT 130 away from the base edge 114 of the first IDT 110. By adjusting the dimensions of the closed adjustable aperture 310, the conductors of the cable 102 are confined into a closed space, thereby causing loosely bundled conductors (e.g., electrical wires) to be more tightly bundled, thus establishing a more robust electrical connection and better current flow between the conductor of the cable 102 and the electrical contact to which the insulation displacement system 100 is connected.

With reference to FIGS. 1, 2 and 3, to facilitate displacing the plates of the respective IDT's into a mating position, the first IDT 110 includes two side edges 120*a* and 120*b* that are formed to define tracks configured to receive the side edges 140*a* and 140*b* of the second IDT 130. The side edges 140*a* and 140*b* of the second IDT 130 are substantially flat and fit into the tracks defined by the formed side edges 120*a* and 120*b* of the first IDT 110. As shown in FIGS. 1, 2 and 3, the formed side edges 120*a* and 120*b* of the first IDT 110 are curved inwardly. However, the side edges 120*a* and 120*b* may be formed to define tracks having other configurations. Further, the side edges 140*a* and 140*b* of the second IDT 130 may similarly be formed to define tracks configured to receive the side edges of the first IDT 110.

As further shown in FIGS. 1, 2 and 3, the first IDT 110 and the second IDT 130 may include respective stiffening ribs, shown arc-shaped 122 and 142, configured to prevent slot deformation of the respective slots 118 and 138 when the slots receive the cable 102. The stiffening arc-shaped ribs 122 and 142 of the respective plates 112 and 132 counteract the force exerted on the edges of the slots 118 and 138 by the cable 102. The stiffening ribs 122 and 142 thus increase the durability of the plates 112 and 132 of the IDT's 110 and 130, respectively. As shown in FIG. 3, the arc-shaped ribs on the plates of the mated IDT's 110 and 130 protrude outwardly such that the adjacent surfaces of the mated plates 112 and 132 include the indentation defined by the stiffening ribs 122 and 142.

As further shown in FIGS. 1 and 2, the IDT's 110 and 130 include respective members, or projections, 126 and 146 that are configured to couple the respective IDT's to the electrical contact. Projections 126 and 146 are each electrically conductive members that extend outwardly from the respective plates 112 and 132. The projections 126 and 146 are electrically coupled to the electrically conducting edges of the slots 118 and 138, respectively, and thus are electrically coupled to the conductor of the cable 102 received in the slots.

In the embodiment shown in FIGS. 1, 2 and 3, each of the projections 126 and 146 is a blade, having substantially flat surfaces, that extends from one of the side edges of the respective plates 112 and 132 in a direction that is substantially perpendicularly to the surfaces of the plates. Specifically, the projection 126 extends substantially perpendicularly from the surface of plate 112 that includes the arc-shaped indentation. The projection 146, on the other hand, extends substantially perpendicularly from the surface of the plate 132 of the second IDT 130 that includes the arc-shaped stiffening rib 142. Thus, when the IDT's 110 and 130 are placed in their mated position, the projections 126 and 146 are positioned substantially adjacent to each other such that they define a resultant blade 210 (seen in FIG. 2) having a thickness that is substantially the sum of the thickness of the blades 126 and 146. Further, in the embodiment of the insulation displacement system 100 shown in FIGS. 1, 2, and 3, only a portion of the side edge 120*b* from which the blade 126 extends is formed to define a track that receives a corresponding side edges of the plate 132 of the second IDT 130.

Thus, in operation, a section on one side of the cable 102 is received in the slot 118 of the first IDT 110. Mechanical forces applied either to the cable 102 or to the first IDT 110 cause the received section of the cable 102 to be directed towards the end of the slot 118. The edges of slot 118 slice the insulation of the cable 102 and displace the insulation towards the opening of the slot (i.e., in a direction opposite the direction in which the cable is moving in the slot 118).

A second IDT 130 is positioned so that its slot 138 can receive another section of the cable 102 on the side of the cable that is substantially opposite where the first section of the cable was received by the slot 118 of the first IDT 110. Mechanical forces are applied either to the cable 102 or to the second IDT 130 to cause the second section of the cable to be directed along the slot 138 of the second IDT 130. The edges defining the slot 138 pierce the insulation of the cable 102, and cause the insulation to be displaced towards the opening of the slot 138.

The first IDT 110 and the second IDT 130 are positioned so that the second IDT 130 is received in a mating configuration by the first IDT 110. Particularly, the side edges 140*a* and 140*b* of the second IDT 130 are received in tracks defined by the side edges 120*a* and 120*b* of the first IDT 110. The second IDT 130 is displaced relative to the first IDT 110 such that the second edge 136 of the second IDT 130 moves towards the base edge 114 of the first IDT 110. As the plates are displaced relative to each other the insulator of the cable 102 is displaced.

Once the first IDT 110 and the second IDT 130 are in their mated positions, their respective slots 118 and 138 define a closed adjustable aperture that holds the exposed conductors of the cable 102 in a confined space, thereby enabling the conductor to establish a strong electrical connection with the electrical conducting edges of the slots 118 and 138, thus establishing a strong electrical connection with the electrical contact connected to the insulation displacement system 100.

Figure 4:
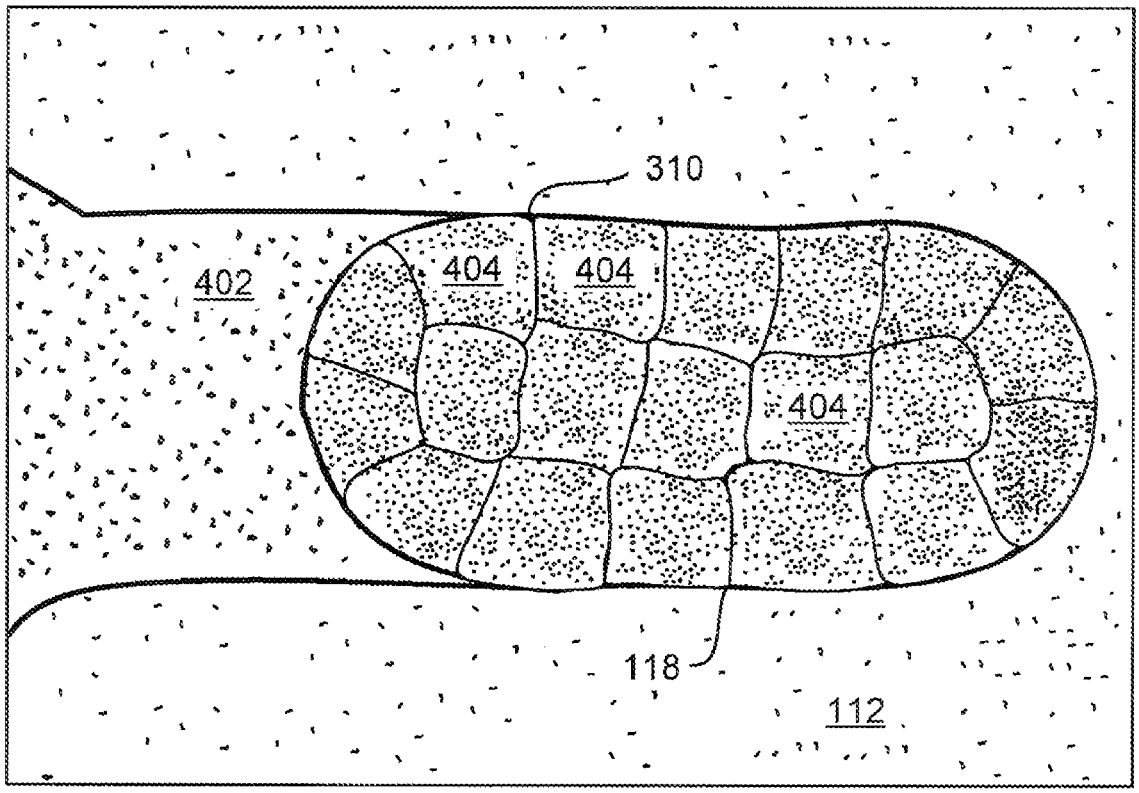
FIG. 4 is a cross-sectional view of the area around the closed aperture formed by the insulation displacement system of FIGS. 1, 2, and 3.

FIG. 4 shows a cross-sectional view of the area around the closed adjustable aperture 310 of the insulation displacement system 100 of FIGS. 1, 2, and 3. As can be seen, the insulation layer 402 of the cable 102 has been displaced, thus exposing the conductors 404. As shown, the slot 118 of the first IDT 110 and the slot 138 (not shown in FIG. 3) of the second IDT 130 define the closed adjustable aperture 310 that keeps the conductors 404 tightly bundled, and thus facilitate the formation of a strong electrical connection between the conductor 404 and the electrically conducting edges of the slots 118 and 138.

Figure 5:
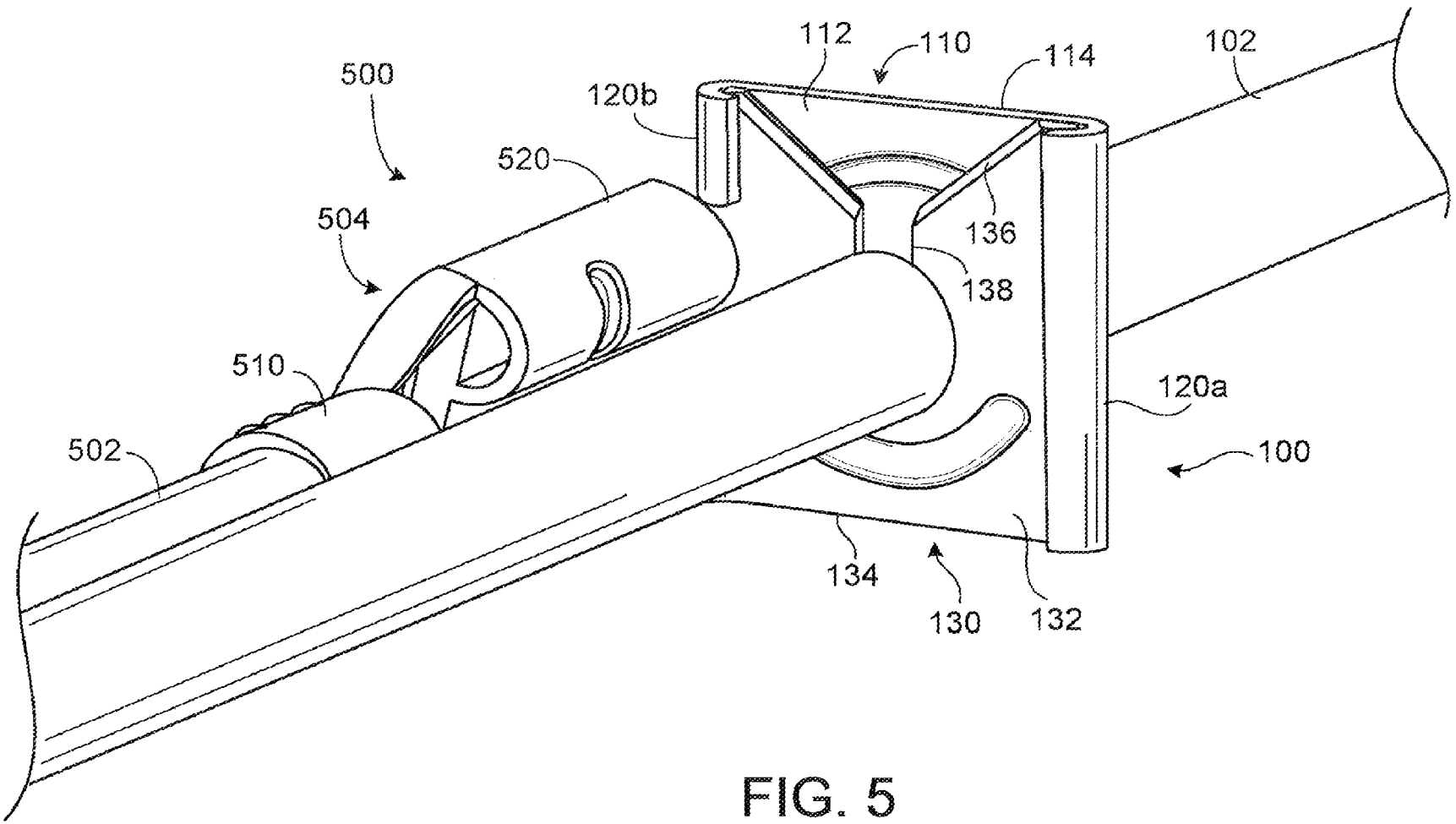
FIG. 5 is a perspective view of an exemplary embodiment of an electrical tap connector that uses the insulation displacement system shown in FIGS. 1, 2 and 3.

FIG. 5 shows a perspective view of an exemplary embodiment of an electrical tap connector 500 that uses an insulation displacement system such as system 100 shown in FIGS. 1, 2 and 3. The electrical tap connector 500 may be used to electrically connect one or more conductors in one cable to one or more conductors of another cable, in effect splicing the two cables. As shown, the electrical tap connector 500 includes an insulation displacement system such as IDS 100. As provided herein, the insulation displacement system 100 includes a first and second insulation terminal 110 and 130 placed in a mating configuration such that their respective slots 118 and 138 define a closed adjustable aperture that holds the conductor of the cable 102 in place. The operation of the insulation displacement system 100 causes the insulator at the section of the cable 102 located substantially in the space defined by closed aperture 310 (shown in FIG. 3) to be displaced, thus enabling the exposed conductor to establish a strong and reliable electrical connection with the electrical conducting edges of the slots 118 and 138.

As shown, the electrical tap connector 500 includes a crimp connector 504 configured to receive the electrical conductor (s) of a second cable 502, and establish an electrical connection between the conductors of the second cable 502 and the conductor of the electrical cable 102 that is electrically coupled to the insulation displacement system 100.

Figure 6:
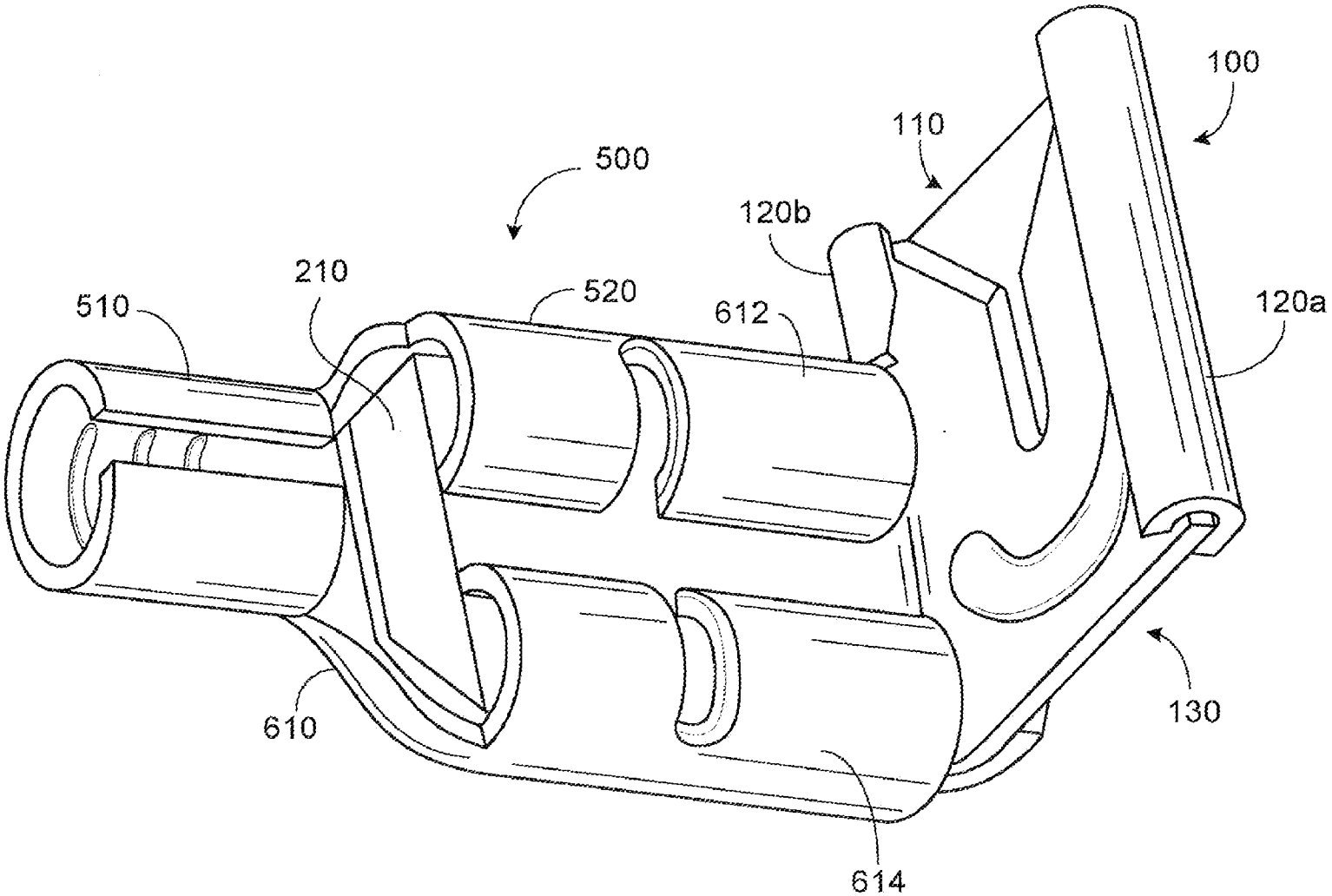
FIG. 6 is a perspective view of the electrical tap connector shown in FIG. 5 mated with a female connecting terminal.

With reference to FIG. 6, showing another perspective view of the electrical tap connector 500, the crimp connector 504 includes a crimp barrel 510 and an electrically conducting receiver such as a socket 520 which is electrically and mechanically connected to the crimp barrel 510. The crimp barrel 510 is configured to receive the conductors of the second cable 502 (shown in FIG. 5). When the conductors of the cable 502 are received in the crimp barrel 510, a crimping force is applied to the barrel, thereby causing the electrically conducting walls of the crimp barrel 510 to inwardly contract and establish an electrical connection between the conductors of the cable 502 and the internals electrical conducting walls of the crimp barrel 510. Other types of connectors and/or adapters configured to receive and establish an electrical connection with electrical conductors may be used instead of the crimp barrel.

The socket 520 includes a socket base 610, an upper rolled-rail fastener 612 that extends from a first side of the socket base 610, and a lower rolled-rail fastener 614 that extends from the side opposite the first side of the socket base 610. The upper rolled-rail fastener 612, lower rolled-rail fastener 614, and the socket base 610 define a slot that is configured to receive an electrical conducting blade, such as the resultant blade 210. Other types of fasteners (e.g., female fasteners) may be used to receive the electrical conducting projections extending from the IDS.

As shown in FIG. 6, the resultant blade 210, formed from the adjacent placement of the respective electrical conducting blades 126 and 146 of the first and second IDT's 110 and 130, is received in slot of the socket 520 of the crimp connector 504. The upper rolled-rail fastener 612 and the lower rolled-rail fastener 614 are configured to hold the blade 210 within the socket 520 by exerting spring forces on the blade 210.

Although FIGS. 5 and 6 show an exemplary embodiment of a crimp connector that is used with the electrical tap connector 500, other crimp connectors may also be used. Examples of suitable crimp connectors are described in U.S. patent application Ser. No. 10/828,156, filed Apr. 20, 2004 and entitled "Crimp Connector", the contents of which are hereby incorporated by reference in their entirety. Furthermore, other type of connectors, such as ring or fork terminal, PCB mounts, etc., which are configured to establish an electrical connection between a conductor and another electrical contact, may also be used. Further, although the exemplary embodiment of FIGS. 5 and 6 shows that the electrical connection between the insulation displacement system 100 and the crimp connector 504 is established by inserting the blade 210 into the socket 520 of the crimp connector 504, the electrical connection may be established by inserting only one of the electrical projections 126 or 146 into the socket 520.

Thus, in operation, an insulation displacement system, such as a system 100, is used to electrically couple the conductor of the cable 102 to the insulation displacement system 100. At least one of the electrical conducting blades 126 and/or 146 is placed in an electrically conducting receiver, such as the socket 520 of the crimp connector 504 shown in FIGS. 5 and 6. The socket 520 is electrically and mechanically coupled to the crimp barrel 510 that receives the second electrical cable 502. The conductor(s) of cable 502 is received in the crimp barrel 510, and is maintained in the crimp barrel 510 by applying crimping force to the crimp barrel 510 to cause the walls of the crimp barrel to contract, and thus form a tight connection with the conductor of the cable 502. Thus, an electrical connection is established between the conductors of cable 502 and the conductors of cable 102, causing the conductors of the two cables to become, in effect, spliced.

Figure 7:
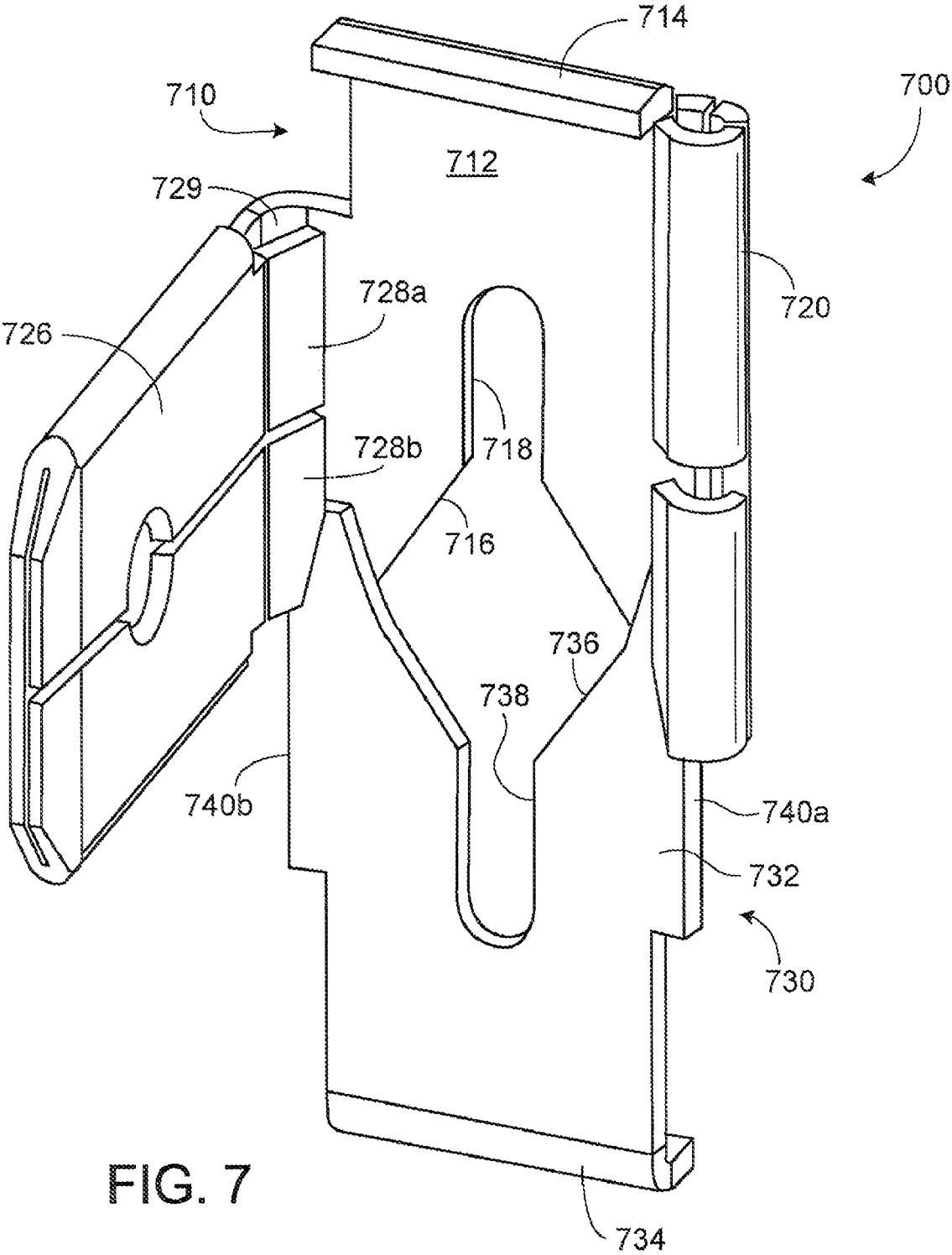
FIG. 7 is a perspective view of another embodiment of an insulation displacement system.

FIG. 7 shows another embodiment of an insulation displacement system that is configured to maintain its mated IDT's in a mechanically stable formation. As shown, an insulation displacement system (IDS) 700 includes a first insulation displacement terminal 710 having a plate 712. The plate 712 has a base edge 714, and a second edge 716 that is located opposite the base edge 714. A slot 718 that is configured to receive an electrical cable extends from the second edge 716 towards the center of the plate 712. In some embodiments the base edge 714 is bent so that it forms an angled portion with respect to the plate 712. The bent base edge facilitates pushing the IDT 710 against the cable received in the slot 718. In some embodiments the second edge 716 of the plate 712 is V-shaped to enable the cable to be easily guided along the contours of the second edge 716 towards the opening of the slot 718.

The IDT 710 is adapted to receive in a mating configuration a second IDT, such as IDT 730. The second IDT 730 includes a flat plate 732 that includes a base edge 734 and a second edge 736. In some embodiments the base edge 734 is bent so that it forms an angled portion with respect to the plate 732. A slot 738 extends from the second edge 736 towards the center of the plate 732. The edges defining the slot 738 are electrically conducting. In some embodiments the second edge 736 of the second IDT 730 is V-shaped, and the slot 738 extends from the V-shaped edge towards the center of the second plate 732.

To facilitate displacing the plates of the respective IDT's into their mating positions, the first IDT 710 includes a rolled receiver 720 that defines a passage or channel for receiving side edge 740*a* of the second IDT 730. The rolled receiver 720 is configured to fixture and lock the second IDT 730 near the side edge 740*a* when the two IDT's 710 and 730 are placed in their mated configuration, thereby providing stable mechanical contact between the first IDT 710 and the second IDT 730.

As further shown in FIG. 7, the first IDT also includes a projection 726 which is shaped as a blade and is configured to form an electrical connection with an electrical contact (not shown) such as a socket. As can be seen, the projection 726 is formed by folding a flat sheet extending from the plate 712 to form the resultant folded projection. Optionally, the sheet that is folded may have perforation to facilitate the folding operation. As also shown in FIG. 7, extending from the folded projection 726 are two pivotable plates 728*a* and 728*b*. The two pivotable plates, together with the section 729 of the front surface of the projection 726 extending from the plate 712, define a passage into which the side edge 740*b* of the second IDT 730 is received when the IDT's 710 and 730 are directed into their mated configuration. The two pivotable plates 728*a* and 728*b* can be biased towards the section 729 such that they exert a force on the portion of the IDT 730 near side edge 740*b* that is received in the passage, thereby maintaining the IDT's 710 and 730 in a stable mechanical contact. Accordingly, the folded projection 726 is used not only to form an electrical connection between the IDS 700 and another electrical contact, but also to define a passage that helps form a stable mechanical formation between the two IDT's 710 and 730.

In operation, the IDT 730 is directed into mating configuration with the IDT 710 by guiding the second edge 736 into the passage defined by the rolled rail fastener 720 and the passage defined by pivotable plates 728*a* and 728*b*. To insert the second edge 736 into the passage formed in the IDT 710 some degree of force may be required to overcome the biasing force exerted by the rolled rail fastener and the pivotable plates. The IDT 730 is then displaced so that its second edge 736 moves towards the base edge 714 of the first IDT 710.

An electrical cable (not shown) is placed in the closed adjustable aperture defined by the two opposing slots of the displaced IDT's 710 and 730. The two IDT's may then continue moving towards each other until the slots 718 and 738 slice the insulation of the cable and establish an electrical connection between the IDS 700 and the cable. When the two IDT's 710 and 730 have reached their final mated position, the mechanical forces exerted by the rolled rail fastener 720 and pivotable plates 728*a* and 728*b* on the IDT 730 maintain the IDT's 710 and 730 in a secure mechanical contact. The projection 726 is then connected to the electrical contact to establish the electrical connection between the cable placed in the closed adjustable aperture defined by the slots 718 and 738 and the electrical contact.

Figure 8:
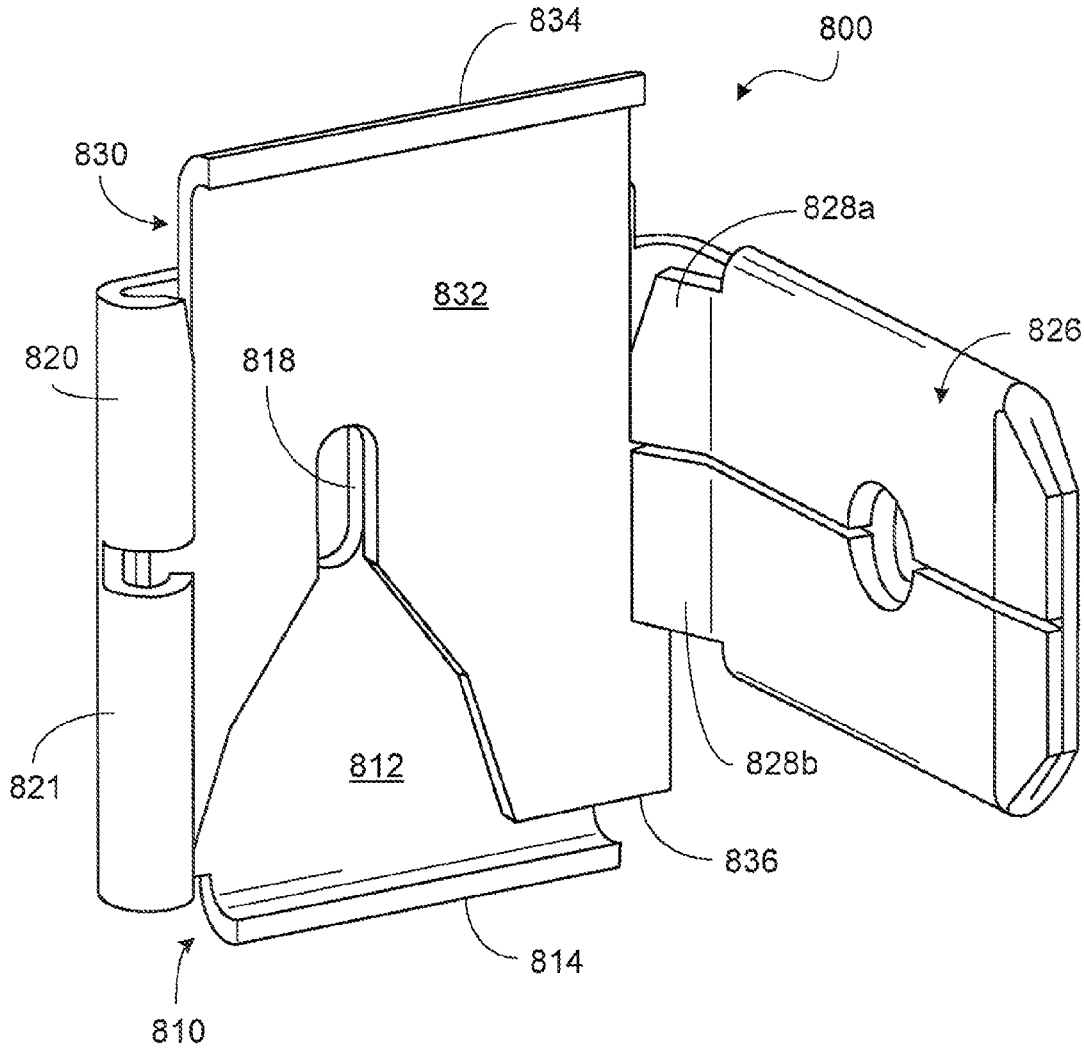
FIG. 8 is a perspective view of another embodiment of an insulation displacement system.
Figure 9:
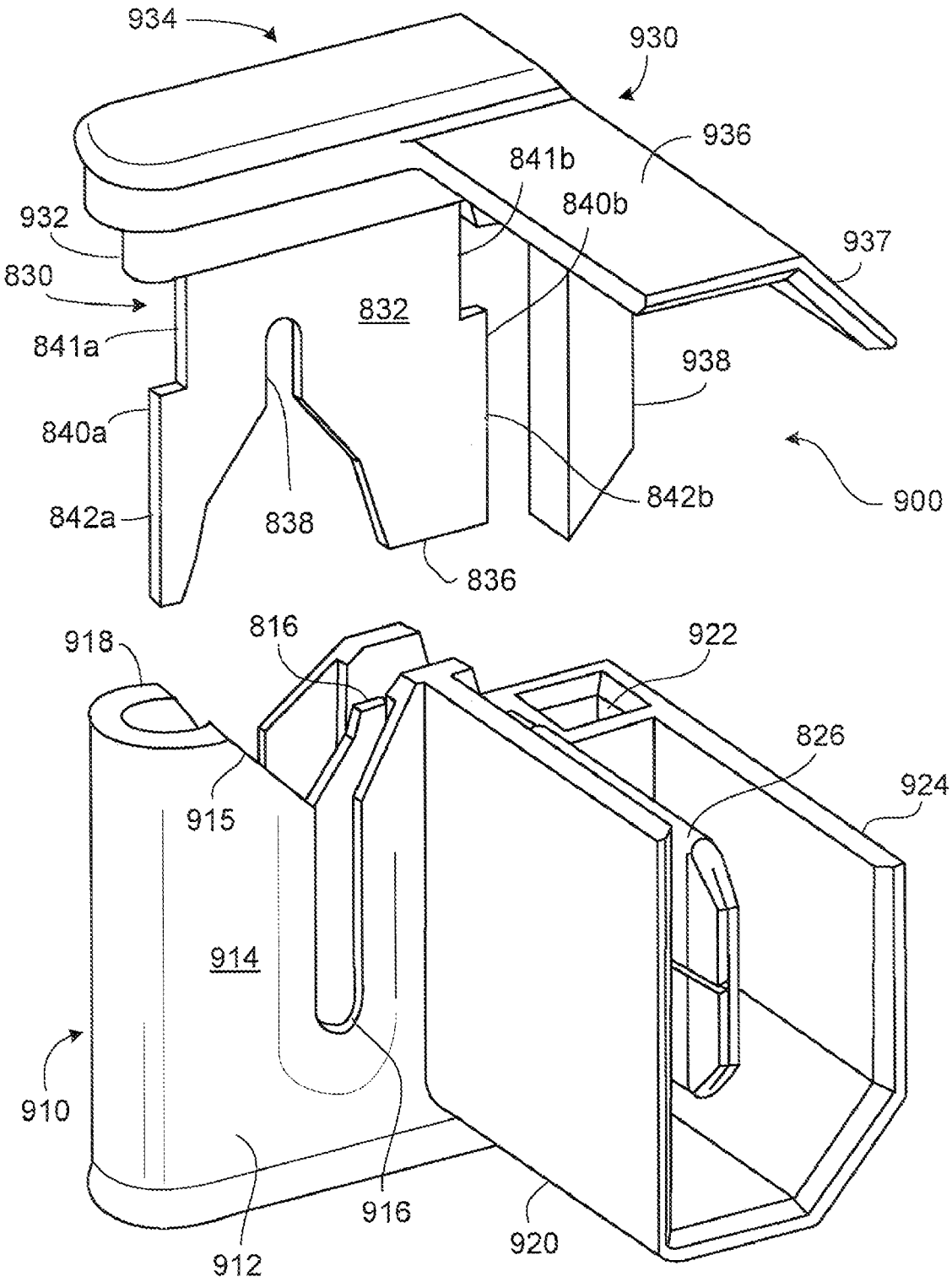
FIG. 9 is a perspective view of an assembly that includes the insulation displacement system of FIG. 8 and corresponding housing components.

FIGS. 8 and 9 show another embodiment of an insulation displacement system (IDS) 800. The IDS 800 is adapted to fit in a housing constructed from suitable electrically insulating materials, and thus provide electrical insulation as well as mechanical stability. Like the IDS 700 (shown in FIG. 7), the IDS 800 includes a first insulation displacement terminal (IDT) 810 having a plate 812. The plate 812 has a base edge 814, and a second edge 816 (shown in FIG. 9) that is located opposite the base edge 814. A slot 818 that is configured to receive an electrical cable extends from the second edge 816 towards the center of the plate 812. The edges defining the slot 818 are electrically conducting.

In some embodiments the base edge 814 is bent so that it forms an angled portion with respect to the plate 812. As noted above with respect to IDS 700, the bent base edge facilitates pushing the IDT 810 against the cable received in the slot 818. In some embodiments the second edge 816 (as shown in FIG. 9) of the plate 812 is V-shaped to enable the cable to be easily guided along the contours of the second edge 816 towards the opening of the slot 818.

The IDT 810 is adapted to receive in a mating configuration a second IDT, such as IDT 830. The second IDT 830 includes a flat plate 832 that includes a base edge 834 and a second edge 836. In some embodiments the base edge 834 is bent so that it forms and angled portion with respect to the plate 832. A slot 838 (shown in FIG. 9) extends from the second edge 836 towards the center of the plate 832. The edges defining the slot 838 are electrically conducting. In some embodiments the second edge 836 of the second IDT 830 is V-shaped, and the slot 838 extends from the V-shaped edge towards the center of the second plate 832.

In their mated position, the overlapping slots 818 and 838 define an aperture that can be precisely controlled. The size of the aperture can be adjusted so as to preclude exposed electrical wires of the cable from migrating up either of the slots 818 and/or 838.

The first IDT 810 includes an upper rolled rail fastener 820 and a lower rolled rail fastener 821. The upper and lower fasteners 820 and 821 define a passage configured to receive a stepped side edge 840*a* of the second IDT 830. The stepped side edge 840*a* includes a cut section 841*a* and a protruding section 842*a* that protrudes outwardly relative to the cut section 841*a*. The upper and lower rolled rail fasteners 820 and 821 are configured to fixture and lock the second IDT 830 when the two IDT's 810 and 830 are placed in their mated configuration, thereby providing stable mechanical contact between the first IDT 810 and the second IDT 830. Particularly, as the plate 832 is displaced towards the base edge 814 of the first IDT 810, the protruding section 842*a* is guided along the passage defined by the rolled rail fasteners 820 and 821. Both rolled rail fasteners 820 and 821 are resiliently biased in the direction of the plate 812 of the first IDT 810. Thus, once the protruding section 842*a* passes through the upper rolled rail fastener 820, the upper rolled rail fastener collapses, through operation of the upper rolled rail fastener's biasing force, towards the plate 812 of the first IDT 810, and thereby hinders retraction of the protruding section 842*a* from the channel defined by the upper and lower rolled rail fasteners 820 and 821. Additionally, the biasing force exerted by the lower rolled rail fastener 821 on the plate 832 facilitates maintaining the IDT's 810 and 830 in a stable mechanical contact.

In some embodiments, and as shown in FIG. 8, the first IDT 810 also includes a projection 826. The projection 826 is formed by folding a flat sheet extending from the plate 812 to form the resultant folded projection. Projection 826 is configured to electrically couple the IDS 800 to an electrical connector, such as a crimp connector, thereby forming an electrical tap connection that can effectively splice two or more individual electrical cables together. The projection 826 may be electrically coupled to other types of electrical contacts.

As further shown in FIG. 8, extending from the folded projection 826 are two deflectable flexible plates 828*a* and 828*b*. The two deflectable flexible plates 828*a* and 828*b* define a passage into which a stepped side edge 840*b* of the second IDT 830 is received when the IDT's 810 and 830 are directed into their mated configuration. Like side edge 840*a*, the stepped side edge 840*b* also includes a cut section 841*b* and a protruding section 842*b*. The two deflectable flexible plates 828*a* and 828*b* are biased inwardly towards the plate 812. Thus, when the side edge 840*b* is received in the passage defined by the plates 828*a* and 828*b*, the upper plate 828*a* will collapse towards the plate 812 once the protruding section 842*b* of the plate 832 has passed the plate 828*a*, thereby hindering retraction of the second IDT 810 from the passage. Additionally, the biasing force exerted by the second plate 828*b* on the plate 832 facilitates maintaining the IDT's 810 and 830 in a stable mechanical contact.

With reference to FIG. 9, an IDS assembly 900 is shown which includes the IDT terminals 810 and 830, each coupled to respective insulating housing components 910 and 930. The housing components 910 and 930 are manufacture from suitable insulating materials such as plastic.

The housing component 930 is configured to be received within the housing component 910, thereby providing the assembly 900 with mechanical stability, and adequately insulating the IDS 800. Housing component 910 includes housing shell 912 which is a hollow insulating shell having a sufficiently large internal volume to receive IDT 810. As shown, shell 912 has two surface walls 914 and 918 that have a shape similar to the shape of IDT 810. Thus, the wall 914 has a top V-shaped edge 915 and a slot 916 that extends from the V-shaped edge 915 towards the center of the wall 914. Wall 918 is similarly shaped. The walls' shape thus enables an electrical cable to be received in the slot 818 of the IDT 810. Housing component 910 further includes shell 920 that defines an internal volume in which the projection 826 is disposed. As can be seen, shell 920 has an opening to enable projection 826 to be coupled (mechanically and electrically) to an electrical contact.

The IDT 830, on the other hand, is coupled to the housing component 930. Particularly, base edge 834 is secured to a projection 932. Securing the base edge 834 to the projection 932 can be performed by, for example, using adhesives, performing ultrasonic welding of the base edge to the projection, and/or using other suitable ways to secure the base edge 834 to the projection 932. Projection 932 has dimensions and a shape that substantially matches the shape of the opening defined by the top edges of the shell 912 of housing component 910 so that when the IDT 830 and the attached housing component 930 are inserted into the shell 912, the projection 932 snugly fits into the top opening of the shell 912.

Attached to the shell 932 is L-shaped cover 934 whose dimensions and shape substantially match the dimension and shape defined by the top edges of housing component 910 so that when the IDT 830 is received in a mating configuration with IDT 810, the cover 934 rests on the top edges of the walls of housing component 910, thereby covering substantially the entire top area defined by housing component 910.

As can further be seen from FIG. 9, extending from a plate 936 forming part of the L-shaped cover 934 is a substantially rectangular-shaped shaft 938. The shaft 938 is configured to be mated in a correspondingly shaped receiving hole 922 disposed in the inner volume defined by shell 920 of the housing component 910. During operation, when the IDT 810 and 830 are being directed into their mating configuration and the housing component 930 is directed to rest on housing component 910, the shaft 938 is received inside the hole 922 to provide a guiding mechanism to reduce alignment mismatch of the housing components 910 and 930 relative to each other. The shaft 938 and the hole 922 thus enhance the mechanical stability of assembly 900. In some embodiments the shaft 938 has a tapered end to facilitates insertion of the shaft 938 into the hole 922.

Also extending from the plate 936 is an angled portion 937 whose exposed edge rests on the top edge of the lower wall 924 of the shell 920 when the IDT's 810 and 830 are placed in their mating position.

Figure 10:
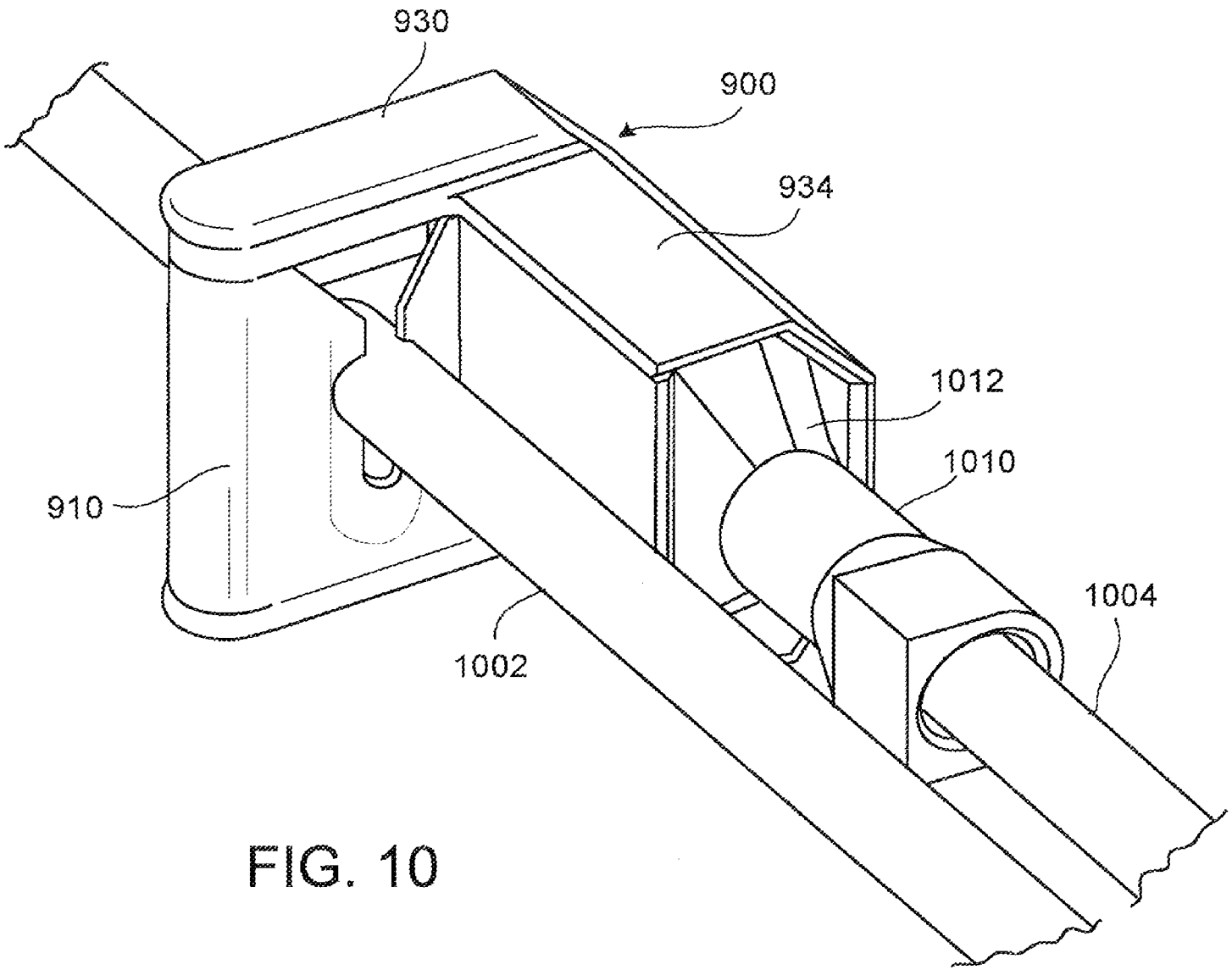
FIG. 10 is a perspective view of an exemplary embodiment of an electric tap connector that uses the assembly shown in FIG. 9.

Thus, in operation, and with reference to also FIG. 10, the IDT 830 is directed into a mating configuration with the IDT 810 by guiding the stepped side edge 840*a* into the passage defined by the upper and lower rolled rail fastener 820 and 821, and by guiding the stepped side edge 840*b* into the passage defined by the deflectable flexible plates 828*a* and 828*b*. The IDT 830 is then displaced so that its second edge 836 moves towards the base edge 814 of the IDT 810.

An electrical cable 1002 is placed in the adjustable aperture defined by the two opposing slots of the displaced IDT's 810 and 830. The two IDT's may then move towards each other until the slots 818 and 838 slice the insulation of the cable and establish an electrical connection between the IDS 800 and the cable.

As the two IDT's 810 and 830 are displaced towards their final mated position, the shaft 938, which as been received in the opening of the hole 922, is displaced inside the hole 922. With the shaft 938 inserted into the hole 922, horizontal movement of the two housing components 910 and 930 relative to each other is reduced. As further shown in FIG. 10, when the IDT's 810 and 830 have reached their mated position, the cover 934 of the housing component 930 rests on top of the housing component 910, with the shell 932 of housing component 930 snugly fitted into the top opening by shell 912 of the housing component 910 (see FIG. 10).

In some embodiments the assembly 900 is used to implement an electrical tap (e.g., to perform a splicing operation). Thus, in such embodiments, the conductor(s) of a cable 1004 may be received in a crimp barrel similar to the one shown in FIG. 5. The conductor thus received in the crimp barrel is maintained and held in place by applying crimping force to the crimp barrel to cause the walls of the crimp barrel to contract and form a tight connection with the conductor of the cable 1004. The crimp barrel is connected to a socket similar to the socket 520 shown in FIG. 5. The projection 826 of IDT 810 is subsequently placed inside the crimp device's socket, thereby establishing an electrical connection between the conductor of cable 1002 and the conductor of cable 1004.

As further shown in FIG. 10, a crimp housing 1010 is placed over the crimp connector to shield it from any stray electrical contact. The crimp housing 1010 has a substantially contiguous structure that includes a funnel section 1012 configured to fit over the opening defined by the housing component 910 and the cover 934 of the housing component 930.

Figure 11:
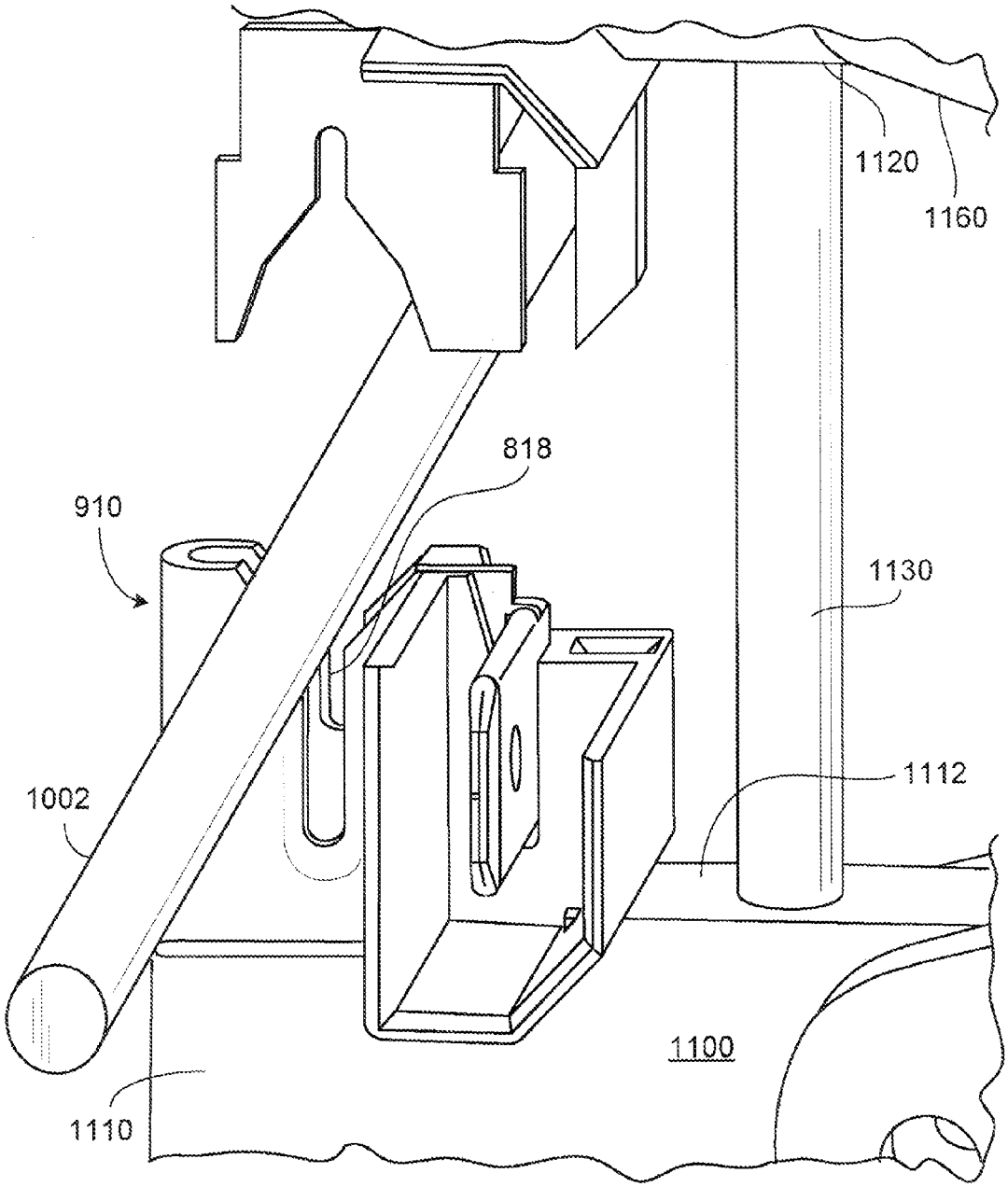
FIG. 11 is a partial side view of an exemplary embodiment of a hand tool used to assemble the assembly shown in FIG. 9.
Figure 12:
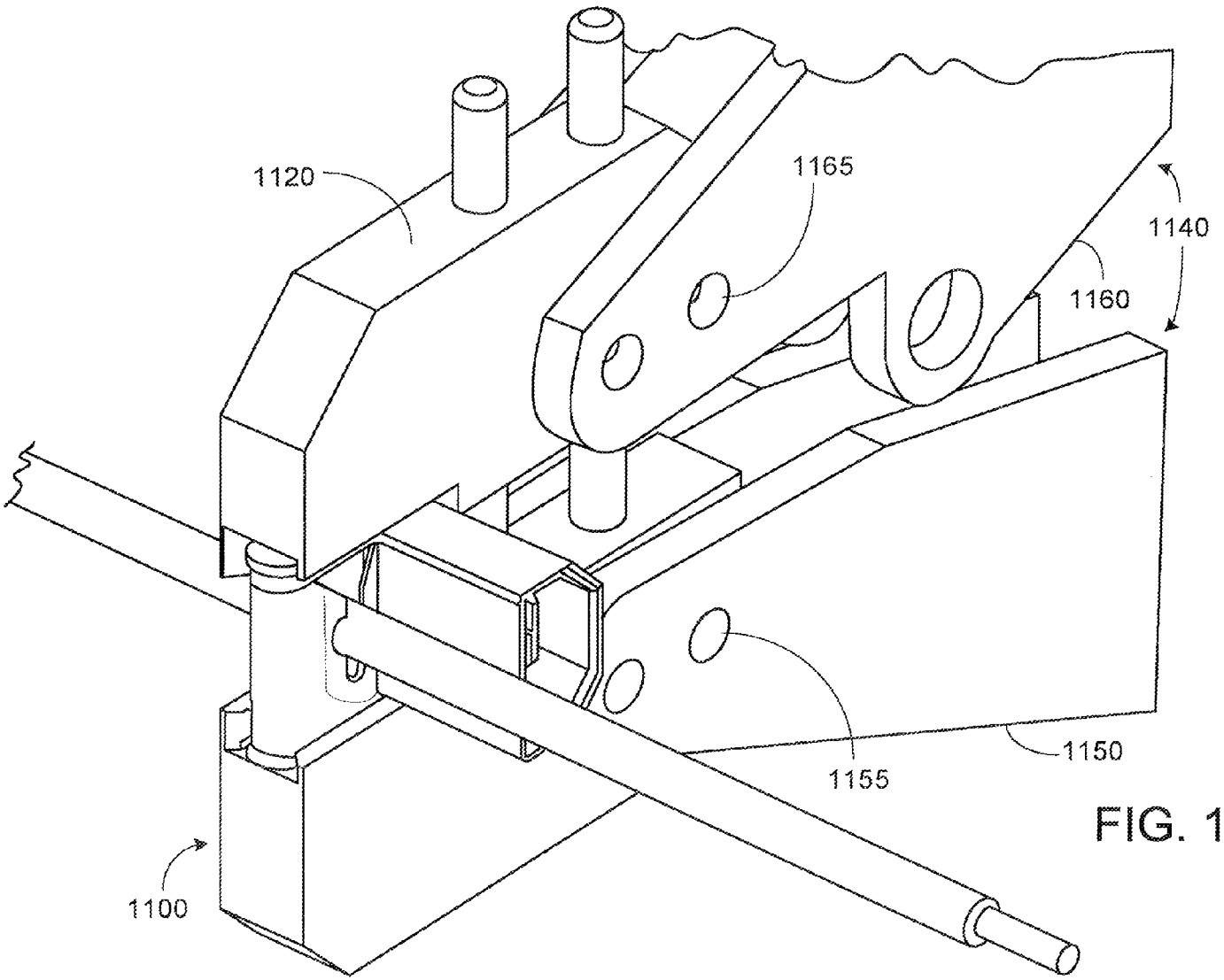
FIG. 12 is a perspective side view of the hand tool shown in FIG. 11 in operation.

With reference to FIGS. 11 and 12, in some embodiments the assembly 900 is configured to be assembled using a hand tool 1100. For example, in some embodiments, the hand tool is a crimping hand tool that enables the assembly 900 to be coupled to an electrical cable, such as cable 1002. The assembly 900 is then coupled to an electrical connector, such as a crimp connector, which in turn is coupled to another cable, such as cable 1004.

As shown, the hand tool 1100 includes a lower nesting jaw 1110 having a top surface 1112 that is configured to receive the housing component 910 into which the IDT 810 is secured. The top surface 1112 of the lower nesting jaw 1110 may include an attachment mechanism to maintain the housing component 910 in a stationary position, relative to the jaw 1110, during operation of the hand tool so that housing component 910 does not move. For example, a suitable attachment mechanism can be an indentation on the top surface of the jaw 1110 to tightly receive the bottom part of the shell 912 of the housing component 910. Other attachment mechanisms for stably securing the housing component 910 to the jaw 1110 can be used. Alternatively, in some embodiments the lower nesting jaw 1110 may not have an attachment mechanism, in which case the housing component 910 is carefully balanced on the lower nesting jaw 1110.

The hand tool 1100 further includes an upper nesting jaw 1120 (shown in FIG. 12) to which the housing component 930 (which itself is secured to IDT 830) is secured. The lower nesting jaw 1110 and the upper nesting jaw 1120 are attached to respective ratcheting jaws 1150 and 1160 of a ratcheting tool 1140 using, for example, receiving holes 1155 and 1165 formed on the ratcheting jaws 1150 and 1160, respectively, which receive pins (not shown) extending from the sides of the nesting jaws 1110 and 1120. The lower and upper nesting jaws 1110 and 1120 are attached to each other through guide pins, such as guide pin 1130 (shown in FIG. 11), that causes the lower and upper nesting jaws 1110 and 1120 to remain parallel to each other when the two nesting jaws are displaced towards each other when actuated by the ratcheting jaws 1150 and 1160. Particularly, when the force is applied (e.g., by a user using the ratcheting tool 1140) on the ratcheting jaws 1150 and 1160, the force causes the ratcheting jaws to rotate in a substantially radial motion. The guide pins attaching the lower and upper nesting jaws 1110 and 1120 thus prevent the nesting jaws from undergoing a similar radial motion, and ensure that the nesting jaws 1110 and 1120 move in a substantially vertical linear direction to reach a closed position. When the two nesting jaws 1110 and 1120 are brought together into a closed position, the IDT's 810 and 830 of the assembly 900 reach their mated position and thus form, for example, the closed configuration of assembly 900 shown in FIG. 10.

Thus, as shown in FIGS. 11 and 12, the cable 1002 is placed over the slot 818 of the IDT 810 secured inside housing component 910. The lower and upper nesting jaws 1110 and 1120, to which the housing components 910 and 920 are secured, are attached to the ratcheting hand tool 1140, and an external force is applied (e.g., through a handle of the ratcheting hand tool 1140) to cause the ratcheting jaws 1150 and 1160 to actuate the nesting jaws 1110 and 1120 and cause them to move towards each other. As the two nesting jaws 1120 and 1110 approach each other to thus form a closed position of the nesting jaws, the cable 1002 is driven into the respective slots 818 and 838 of IDT's 810 and 830, thereby displacing the insulation of cable 1002, and creating an electrical connection between the wires of the cable 1002 and the IDT's 810 and 830. In the nesting jaws' closed position the housing component 930 comes to rest on the housing component 910 in such a way that shell 932 is inserted into the top opening of the shell 914.

Once the cable 1002 is electrically coupled to the IDS 800, a crimp connector, or some other type of an electrical connector, to which the second cable 1004 is electrically coupled (the electrical coupling of the cable 1004 to the crimp connector may have been formed in advance), is connected to the IDS 800 using the projection 826, to complete the electrical tap.

Figure 13A:
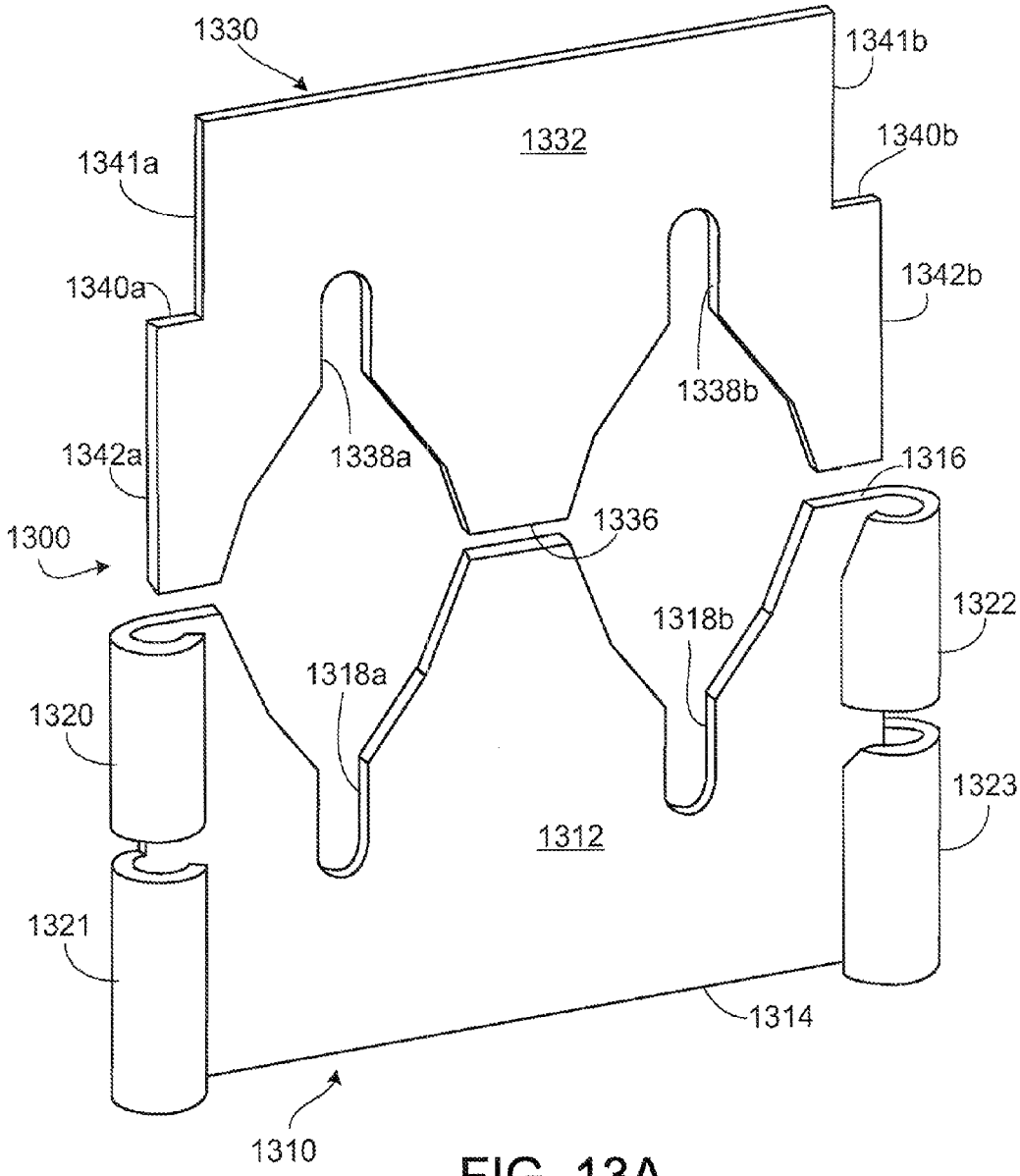
FIG. 13A is a perspective view of another exemplary embodiment of an insulation displacement system.

FIG. 13A is a perspective view of another exemplary embodiment of an insulation displacement system 1300. The IDS 1300 is configured to displace the insulation and establish an electrical contact with at least two electrical cables. Thus, in some embodiments the IDS 1300 can be used to create an electrical tap between two separate cables.

As shown, the IDS 1300 includes a first insulation displacement terminal 1310 having a plate 1312. The plate 1312 has a base edge 1314, and a second edge 1316 that is located opposite the base edge 1314. The plate 1310 includes two slots, 1318*a* and 1318*b*, that are each configured to receive electrical cables. Each of the slots 1318*a* and 1318*b* extends from the second edge 1316 towards the center of the plane 1312. In some embodiments the second edge 1316 is configured to form two V-shaped cuts extending to the openings of the slots 1318*a* and 1318*b*. The V-shaped cuts enable the electrical cables that are to be received in the respective slots to be easily guided along the contours of the V-shaped cuts towards the opening of the slots.

The IDT 1310 is adapted to receive in a mating configuration a second IDT, such as IDT 1330. The second IDT 1330 includes a plate 1332 that includes a base edge 1334 and a second edge 1336. Like the plate 1310, the plate 1330 includes two slots, 1338*a* and 1338*b*, that are each configured to receive electrical cables. Each of the slots 1338*a* and 1338*b* extends from the second edge 1336 towards the center of the plate 1332. In some embodiments, the second edge 1336 is configured to form two V-shaped cuts extending to the openings of respective slots 1338*a* and 1338*b*.

Figure 13B:
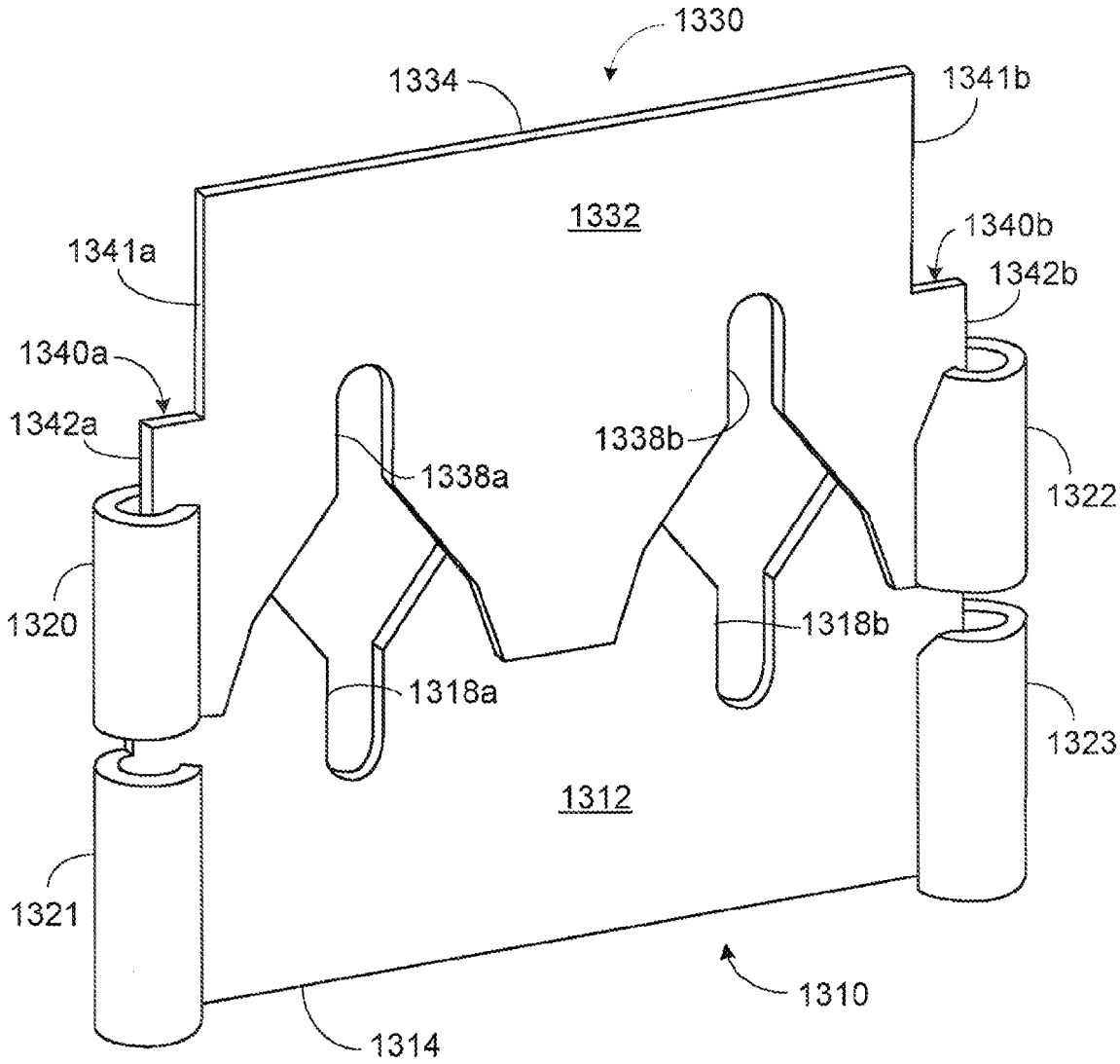
FIG. 13B is a perspective view of the insulation displacement system of FIG. 13A in which the insulation displacement terminals are partially in their mated position.

With reference to FIG. 13B, in their mated position, the respective overlapping slots, namely, slot 1318*a* with slot 1338*a*, and slot 1318*b* with slot 1338*b*, define respective apertures that can be controlled. The size of the apertures can be adjusted to preclude exposed electrical wires of the cable from migrating up any of the slots.

The first IDT 1310 includes an upper and lower rolled rail fasteners 1320 and 1321 on one side of the plate 1312, and an upper and lower rolled rail fasteners 1322 and 1323 on the other side of the plate 1312. The upper and lower rolled rail fasteners 1320 and 1321 define a passage configured to receive a stepped side edge 1340*a* of the second IDT 1330. Similarly, the upper and lower rolled rail fasteners 1322 and 1323 define a passage configured to receive a stepped side edge 1340*b* of the second plate 1332. Each of the stepped sides edges includes a cut section and a protruding section that protrudes outwardly relative to the cut section.

The two sets of upper and lower rolled railed fasteners are configured to fixture and lock the second IDT 1330 when the two IDT's 1310 and 1330 are placed in their mated configuration, thereby providing stable mechanical contact between the two IDT's. Particularly, as the plate 1332 is displaced towards the base edge 1314 of the first IDT 1310, the protruding section 1342*a* is guided along the passage defined by the rolled rail fasteners 1320 and 1321, while the protruding section 1342*b* is guided along the passage defined by the rolled rail fasteners 1322 and 1323. Thus, once the protruding sections pass entirely through the upper rolled rail fasteners 1320 and 1322, respectively, the upper rolled rail fasteners collapse, through operation of the upper rolled rail fasteners' biasing force, towards the plate 1312, and thereby prevent the protruding sections 1342*a* and 1342*b* from being retracted from the passages defined by the rolled rail fasteners.

In operation, when the IDS is used to create an electric tap and thus splice two separate electrical cables, one electrical cable (not shown) is placed into the slot 1318*a* while the other cable (not shown) is placed into the slot 1318*b* of the IDT 1310. Subsequently, the side edges 1340*a* and 1340*b* of the second IDT 1330 are placed into the passages defined by the rolled rail fasteners of the IDT 1310, and the IDT 1330 is directed into a mating configuration with the IDT 1310. As the apertures defined by the overlapping slots of the IDT's decrease in size, the electrical cables, which typically have diameters that are larger than the width of the various slots of the IDS 1300, are sliced and displaced, thus enabling the electrical conducting edges of the slots to form an electrical contact with the electrical wires of the two cables. The dimensions of the apertures can be adjusted as necessary to create a stable electrical and mechanical connection between the IDS 1300 and the wires of the electrical cables.

While FIGS. 13A and 13B show IDT's having two slots, the respective IDT's can have additional slots, thereby enabling the formation of an electrical tap for more than two cables. Further, the IDS 1300 may be modified to include an electrical member configured to electrically connect to an electrical contact. Under such circumstances the IDS 1300 can be used to receive a single electrical cable (thus, one set of overlapping slots will remain empty), and create an electrical connection between that cable and the electrical contact.

OTHER EMBODIMENTS

A number of embodiments of the invention have been described. Nevertheless, it will be understood that various modifications may be made without departing from the spirit and scope of the invention. For example, in some embodiments, the plate 812 of the first IDT 810 and/or the plate 832 of the second IDT 830 may have a circular configuration, or may have other shapes, configurations and dimensions. Further, in some embodiments, only part of the plate 812, and/or the plate 832, may be composed of an electrically conducting material in a manner sufficient to establish an electrical path between the conductor of a cable, such as the cable 1002, shown in FIG. 10, and the electrical contact. Accordingly, other embodiments are within the scope of the following claims.

What is claimed is:

1. An insulation-displacement assembly comprising: a first insulation-displacement terminal (IDT) adapted to receive in a mating configuration a second IDT, the first IDT comprising a first plate that includes: a base edge; and a slot configured to receive an electrical conductor surrounded by an insulator and to displace the insulator, wherein the slot extends towards the center of the first plate from a second edge located opposite the base edge; and a first housing component coupled to the first IDT further comprising a second IDT, the second IDT comprising a second plate that includes: a base edge; and a slot configured to receive the electrical conductor and displace the insulator, wherein the slot extends towards the center of the plate from a second edge located opposite the base edge; and a second housing component coupled to the second IDT; wherein the surface of the plate of the first IDT is placed substantially adjacent to the surface of the plate of the second IDT, and wherein the second edge of the second IDT is displaceable towards the base edge of the first IDT wherein the second edge of each plate of each of the IDT's is V-shaped, and wherein each slot extends from the respective V-shaped edge wherein the slot of the first IDT and the slot of the second IDT are substantially adjacent such that the slots define a closed adjustable aperture configured to hold the electrical conductor.

2. The assembly of claim 1, wherein the first IDT further comprises a folded blade extending from the first plate.

3. The assembly of claim 1, wherein the first IDT further includes a rolled rail fastener configured to fixture and lock the second IDT.

4. The assembly of claim 1, wherein the second housing component is configured to be received in a complementary fit within the first housing component.

5. The assembly of claim 4, wherein the first housing component includes a hollow shell having an opening, and wherein the second housing component includes a projection configured to be received within the opening of the hollow shell of the first housing component.

6. The assembly of claim 1, wherein the first housing component and the second housing component are constructed from an electrically insulating material.

7. The assembly of claim 1, wherein the first IDT is placed inside the hollow shell of the first housing, and wherein the second IDT is secured to the projection of the second housing.

8. The assembly of claim 1, wherein the second housing component includes a shaft, and wherein the first housing component includes a receiving hole configured to receive the shaft.

9. The assembly of claim 1, wherein the first housing component and the second housing components are configured to be placed on an assembly hand tool.

10. The assembly of claim 1, wherein each of the IDT's further comprises at least one additional slot configured to receive a corresponding additional electrical conductor, and wherein when the IDT's are placed in their mated configuration the slots of the first IDT substantially overlap the respective slots of the second IDT.

11. An electrical tap connector assembly comprising:

a first insulation-displacement terminal (IDT) adapted to receive in a mating configuration a second IDT, at least one of the IDT's includes an electrically conducting member, wherein the mated first IDT and the second IDT are configured to electrically couple to a first electrical conductor surrounded by an insulator;

a first housing coupled to the first IDT, and a second housing coupled to the second IDT, wherein the first housing and the second housing are configured to be placed in a complementary fit with each other; and an electrically conducting receiver configured to be electrically coupled to a second electrical conductor, wherein the receiver is configured to receive the electrically conducting member;

wherein each of the IDT's comprises:

a plate that includes:

a base edge; and a slot configured to receive the first electrical conductor and displace the insulator of the conductor, wherein the slot extends towards the center of the plate from a second edge located opposite the base edge;

wherein, in the mating configuration, the surface of the plate of the first IDT is placed substantially adjacent to the surface of the plate of the second IDT, with the slots extending in opposite directions; and wherein, in the mating configuration, the slot of the first IDT and the slot of the second IDT are substantially adjacent such that the slots define a closed adjustable aperture configured to hold the electrical conductor.

12. The assembly of claim 11 wherein the second edge of each plate of each of the IDT's is V-shaped, and wherein each slot extends from the respective V-shaped edge.

13. The assembly of claim 11, wherein the receiver includes a crimp connector comprising a socket that is electrically coupled to a crimp barrel.

14. The assembly of claim 13, wherein the crimp connector is configured to form an electrical connection with the second electrical conductor.

15. The assembly of claim 13, further comprising a receiver housing component coupled to the receiver.

16. An insulation-displacement-system hand tool comprising:

a first nesting jaw configured to receive a first housing component coupled to a first insulation-displacement terminal (IDT) that includes a first plate having a base edge and a slot configured to receive an electrical conductor surrounded by an insulator and to displace the insulator;

a second nesting jaw configured to receive a second housing component coupled to a second IDT that includes a second plate having a base edge and a slot configured to receive the electrical conductor surrounded by an insulator and to displace the insulator; and a ratcheting hand tool having actuating jaws attached respectively to the first nesting jaw and the second nesting jaw, the actuating jaws configured to cause, in response to the application of force on the actuating jaws, the first nesting jaw and the second nesting jaw to move into a closed position such that the when the first housing and the second housing are placed respectively on the first nesting jaw and the second nesting jaw, the first IDT and the second IDT are placed in a mating configuration when the first nesting jaw and the second nesting jaw substantially reach the closed position.

17. A method for electrically coupling an electrical conductor surrounded by an insulator to an electrical contact, the method comprising:

placing on a first nesting jaw of an insulation-displacement-system hand tool a first housing component coupled to a first insulation-displacement terminal (IDT) that includes a first plate having a base edge and a slot configured to receive an electrical conductor surrounded by an insulator and to displace the insulator;

placing on a second nesting jaw of the insulation-displacement-system hand tool a second housing component coupled to a second IDT that includes a first plate having a base edge and a slot configured to receive the electrical conductor surrounded by the insulator and to displace the insulator;

placing the electrical conductor in the slot of first IDT;

applying force to actuating jaws of a ratcheting hand tool, the actuating jaws are attached respectively to the first nesting jaw and the second nesting jaw, to cause the first nesting jaw and the second nesting jaw to move the first housing component and the second housing component into a closed position to thereby cause the first IDT and the second IDT to move into a mating position; and connecting mated IDT's to the electrical contact.

18. The electrical tap of claim 11, wherein the first IDT further includes a rolled rail fastener configured to fixture and lock the second IDT.

19. The electrical tap of claim 11, wherein the plate of the second IDT further includes two substantially flat side edges, and wherein the plate of the first IDT further includes two side edges formed to define tracks configured to receive the respective side edges of the second IDT.

20. The electrical tap of claim 19, wherein the formed side edges of the first IDT are curved inwardly.

* * * * *

UNITED STATES PATENT AND TRADEMARK OFFICE

CERTIFICATE OF CORRECTION

PATENT NO. : 7,413,465 B2
APPLICATION NO. : 11/532205
DATED : August 19, 2008
INVENTOR(S) : Robert N. Taylor It is certified that error appears in the above-identified patent and that said Letters Patent is hereby corrected as shown below:

| | |
|---|---|
| Col. 3, Line 49<br>(App. as filed 9-25-2006<br>Page 5, line 5) | Replace "front" with --first--. |
| Col. 4, line 59<br>(App. as filed 9-25-2006<br>Page 6, line 28) | After "**102**" add the phrase --and to displace the insulation surrounding the conductor of the cable 102--. |
| Col. 12, line 23<br>(App. as filed 9-25-2006<br>Page 18, line 21) | Replace "as" with --has--. |

Signed and Sealed this

Seventeenth Day of November, 2009

David J. Kappos

David J. Kappos
*Director of the United States Patent and Trademark Office*